United States Patent [19]

Jarrett et al.

[11] Patent Number: 4,470,760

[45] Date of Patent: Sep. 11, 1984

[54] FUEL PUMPING APPARATUS

[75] Inventors: Boaz A. Jarrett, Chiswick; Dorian F. Mowbray, Buckinghamshire, both of England

[73] Assignee: Lucas Industries plc, Birmingham, England

[21] Appl. No.: 388,155

[22] Filed: Jun. 14, 1982

[30] Foreign Application Priority Data

Jun. 26, 1981 [GB] United Kingdom ..... 8119787

[51] Int. Cl.[3] ..... F04B 49/00; F04B 19/22

[52] U.S. Cl. ..... 417/221; 417/462; 123/300; 123/449; 123/450

[58] Field of Search ..... 417/218, 221, 251–253, 417/286, 462, 203, 205, 206; 123/449, 450, 300

[56] References Cited

U.S. PATENT DOCUMENTS

| | | | |
|---|---|---|---|
| 2,946,292 | 7/1960 | Chmielecki | 417/206 X |
| 3,410,216 | 11/1968 | Kemp | 417/203 X |
| 3,827,419 | 8/1974 | Isomura | 123/300 |
| 4,083,345 | 4/1978 | Davis | 123/450 |
| 4,173,959 | 11/1979 | Sosnowski et al. | 417/462 X |
| 4,224,903 | 9/1980 | Mowbray | 123/300 |
| 4,242,059 | 12/1980 | Mowbray | 417/462 |
| 4,292,012 | 9/1981 | Brotherston | 417/462 |

FOREIGN PATENT DOCUMENTS

| | | | |
|---|---|---|---|
| 2717323 | 11/1977 | Fed. Rep. of Germany | 417/462 |

*Primary Examiner*—William L. Freeh
*Assistant Examiner*—Paul F. Neils

[57] ABSTRACT

A fuel pumping apparatus for supplying fuel to an internal combustion engine is of the rotary distribution type in which the outward movement of pumping plungers is determined by stops, the axial position of the distribution member being adjustable to determine in conjunction with the stops the amount of fuel delivered by the apparatus. The plungers are actuated by cam lobes on a cam ring and two types of cam lobe are provided. One type of lobe provides the normal pumping action while the other type of lobe is shaped to provide an initial delivery of fuel by the apparatus in advance of the main quantity of fuel. The initial quantity can be varied by moving the cam ring angularly.

4 Claims, 7 Drawing Figures

FUEL PUMPING APPARATUS

Figure 1:
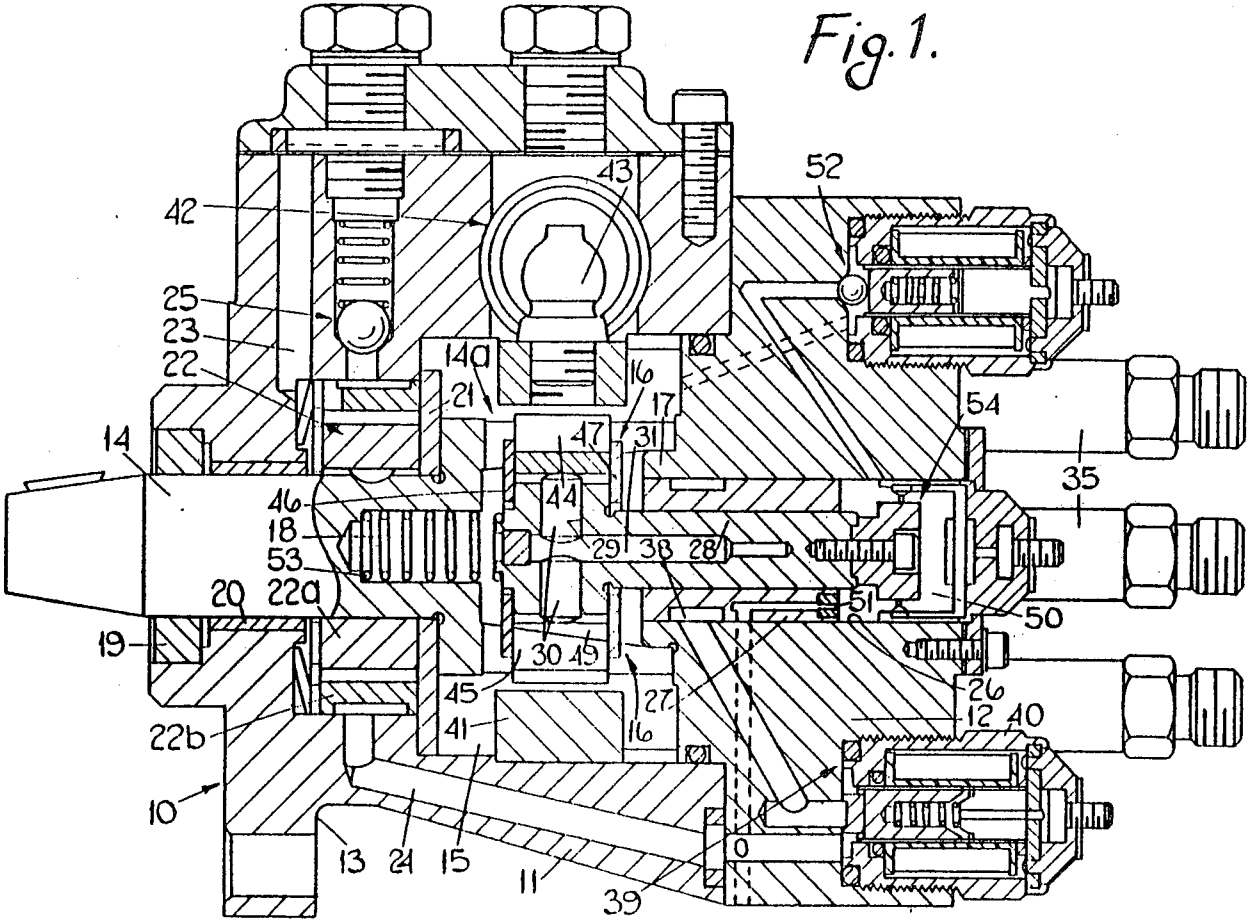

This invention relates to a fuel pumping apparatus for supplying fuel to an internal combustion engine and of the kind comprising a rotary distributor member mounted within a body part, the distributor member being arranged in use to be driven in timed relationship with an associated engine, a pumping plunger housed within a bore formed in the distributor member, a cam ring having internal pumping lobes for imparting inward movement to the plunger as the distributor member rotates, co-operating means in the distributor member and body part for conveying fuel displaced during successive inward movements of the plunger to outlet ports in turn, passage means in the distributor member for communication with an inlet port in the body part, a low pressure fuel supply pump having an outlet communicating with said port, fuel being supplied to said bore to effect outward movement of the plunger and adjustable stop means for limiting the outward movement of the plunger whereby the amount of fuel delivered at each inward stroke of the plunger can be varied.

One example of an apparatus of the kind set forth above is described in the specification of published British Application No. 2037365A. In the apparatus shown in this specification two plungers are provided, the outward movement of which is controlled by inclined stops which function to control the outward movement because the distributor member is axially movable within the body part.

It is desirable when supplying fuel to a compression ignition engine, to be able to deliver an initial volume of fuel in advance of the main volume of fuel in order to improve the efficiency of operation of the engine and to reduce the combustion noise. Various arrangements are known for achieving this object for example, it is known to provide valves in the fuel outlets or in the fuel lines connecting the fuel outlets with the injection nozzles respectively of the engine. The valves operate to store or spill a volume of fuel from the total volume of fuel delivered by the apparatus. Other forms of apparatus have used modified cam forms. In the known cases the initial delivery of fuel is a fixed amount irrespective of the total amount eventually delivered to the engine. Moreover, difficulties can arise with the known arrangements as the speed of operation increases. It is desirable to be able to adjust the initial volume of fuel independently of the main volume of fuel and the object of the present invention is to provide an apparatus of the kind specified in which this desideratum is achieved.

According to the invention an apparatus of the kind specified includes a further plunger mounted in a further bore and a further cam lobe or cam lobes on said cam ring is positioned to actuate the further plunger in advance of the first mentioned plunger, said cam lobe or cam lobes having a leading flank which effects inward movment of the further plunger and a filling flank which precedes said leading flank when considered in terms of the direction of rotation of the distributor member, said filling flank allowing outward movement of the further plunger and controlling the outward movement of the further plunger whilst the passage means moves out of register with the inlet port, and means for adjusting the angular setting of said cam ring within the body part.

Figure 2:
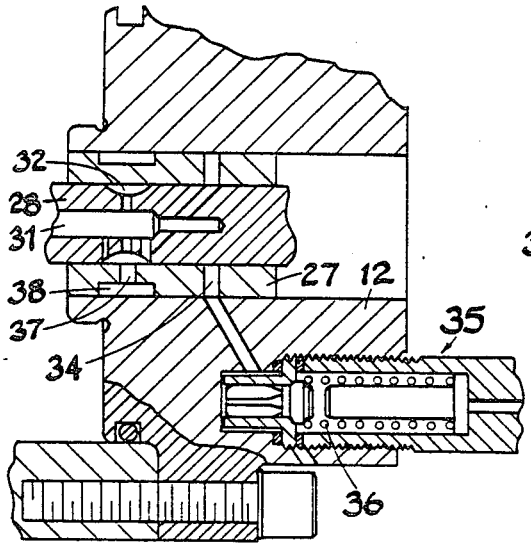
Figure 3:
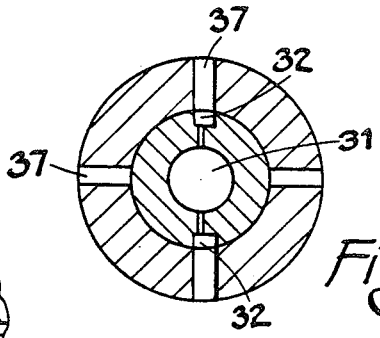
Figure 4:
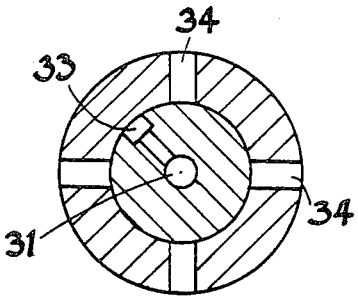
Figure 5:
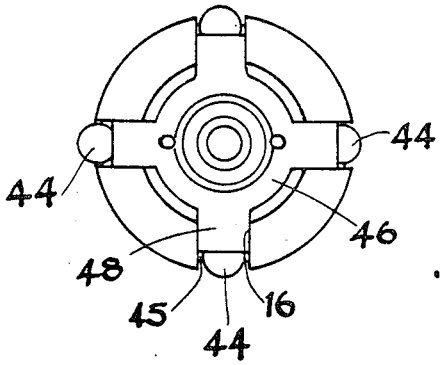
Figure 6:
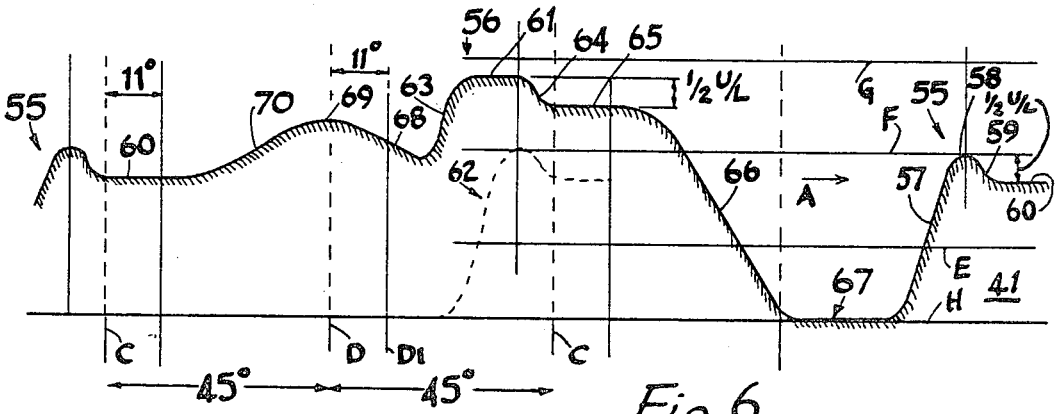
Figure 7:
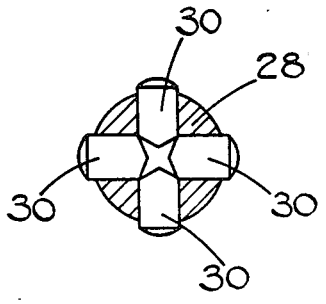

An example of an apparatus in accordance with the invention will now be described with reference to the accompanying drawings in which:

FIG. 1 is a sectional side elevation of an example of the apparatus,

FIG. 2 is a section of a part of the apparatus seen in FIG. 1 taken along a different radial plane, FIGS. 3 and 4 are sections through parts of the apparatus seen in FIGS. 1 and 2, FIG. 5 is a section through part of the apparatus seen in FIG. 1, FIG. 6 is a developed view of the cam lobes of the cam ring, and FIG. 7 is a section through the distribution member in the plane of the pumping plungers.

Referring to FIGS. 1–5 of the drawings, the apparatus comprises a body part generally indicated at 10 and which conveniently is formed by a generally cup-shaped portion 11 the open end of which is closed by a closure portion 12. The body portion 10 is provided with apertured lugs 13 whereby in use the apparatus can be secured to the engine with which it is associated.

The body portion 11 mounts a rotary drive shaft 14 which in use is coupled to a drive member of the associated engine so that it is rotated in synchronism with the engine. The drive shaft 14 extends into a generally cylindrical chamber 15 defined by the two body portions and it has an enlarged cup-shaped portion 14A within the chamber. This enlarged portion is provided with two pairs of diametrically disposed slots 16, the slots being disposed at right angles to each other. The enlarged portion of the drive shaft is hollow and at its end remote from the smaller diameter portion of the shaft, is of right cylindrical form and locates about a spigot portion 17 defined by the body part 12. The remainder of the interior surface of the englarged portion of the drive shaft tapers for a purpose which will be described. In addition, the drive shaft is provided with a counter bore 18. An oil seal 19 is provided at the outer end of the body portion for engagement with the drive shaft and the shaft is supported by a sleeve bearing 20, the shaft being given additional support by the spigot 17. The shaft is located against axial movement by thrust surfaces one of which is defined by an annular plate 21 which surrounds the drive shaft and which also serves as an end closure for a low pressure fuel supply pump 22. The rotor 22A of the supply pump is carried by the drive shaft 14 and it carries vanes which co-operate with an eccentrically disposed surface on a stator ring 22B which is carried within the body portion 11. The low pressure pump has a fuel inlet 23 and a fuel outlet 24. A relief valve 25 is provided to ensure that the output pressure of the pump remains within desired limits, the relief valve acting to permit fuel to flow from the outlet of the pump to the inlet.

Formed in the body portion 12 is a cylindrical bore 26 in which is fixed a sleeve 27. The sleeve 27 accommodates an angularly and axially movable distributor member 28 which projects into the chamber 15 and has an enlarged head portion lying within the chamber. Formed in the head portion is a pair of transversely extending bores 29 in which are located two pairs of pumping plungers 30 respectively. The bores 29 communicate with a blind passage 31 formed in the distributor member and which at its end within the head portion is sealed by means of a plug. As is more clearly shown in FIGS. 2, 3 and 4, the passage 31 communicates with a pair of diametrically disposed longitudinal slots 32 formed in the periphery of the distributor member and communicating with the passage 31 by means of a plurality of connecting passages. The passage 31 also communicates with a further longitudinal slot 33 formed in the periphery of the distributor member and this slot communicates in turn with a plurality of outlet ports 34 formed in the sleeve 27 and communicating with outlets 35 respectively in the body portion 12.

Each outlet 35 incorporates a conventional form of delivery valve 36. The slots 32 register in turn with diametrically disposed inlet ports 37 formed in the sleeve 27 and communicating with a circumferential groove 38 formed in the periphery of the sleeve. The groove 38 communicates with the outlet 24 of the low pressure pump 22 by way of an on/off valve 39 conveniently controlled by an electromagnetic actuator 40. If desired a single slots 32 may be provided with the number of inlet ports being equal to the number of outlets.

Surrounding the head portion of the distributor member 28 is an annular cam ring 41 on the internal peripheral surface of which are formed pairs of diametrically disposed cam lobes. In the particular example two pairs of cam lobes are provided since the apparatus is intended to supply fuel to a four cylinder engine. The cam ring 41 is angularly movable about the axis of rotation of the distributor member by means of a fluid pressure operable device generally indicated at 42 and connected to the cam ring by way of a radially disposed peg 43. The device 42 conveniently includes a resiliently loaded piston housed within a cylinder to one end of which liquid under pressure can be supplied to act on the piston to urge the piston against the action of its resilient loading.

Positioned at the outer ends of the plungers are cam followers respectively each of which comprises a roller 44 carried in a shoe 45. The followers are retained axially relative to the distributor member by a pair of side plates 46, 47 which are secured to the side faces of the head portion of the distributor member. Conveniently and as shown in FIG. 5, the side plates are of annular form having outwardly extending tongues 48 which locate in the slots 16 formed in the enlarged portion of the drive shaft. In FIG. 5 the plate 46 is seen, the plates acting to transmit rotary motion to the distributor member from the drive shaft. The shoes 45 are also located within the aforesaid slots 16 and the rotary motion is transmitted to the shoes directly by the drive shaft. The circumferential side faces of the shoes are provided with circumferentially extending projections 49, the radially outer surfaces of which are tapered to co-operate with the tapered internal surface of the enlarged portion of the drive shaft 14.

Turning now to FIG. 6, this shows a developed view of part of the internal peripheral surface of the cam ring 41. The cam ring has two pairs of cam lobes. One pair being indicated at 55 and constituting the lobes which effect delivery of the main volume of fuel to the associated engine. The other pair of cam lobes one of which is indicated at 56, is concerned with the delivery of the initial volume of fuel to the engine. Considering the lobes 55, these have a leading flank 57 with which the rollers 44 engage to deliver the main volume of fuel. The lobes 55 also have crest portions 58 and a short trailing flank 59 which merges into a portion 60 during which no outward movement of the rollers and therefore the associated plungers, can take place. The direction of movement of the rollers relative to the cam ring 41 is indicated by the arrow A.

Turning now to the cam lobes 56. These are of a complex shape and the crests 61 of these lobes are flat so that whilst the rollers are moving along the crests, no inward movement of the associated plungers can take place. In dotted outline at 62 there is indicated the outline of the main cam lobe 55 and it will be observed that the leading flanks 63 of the cam lobes 56 are positioned in advance when considered in terms of the direction of rotation of the distributor member, of the leading flanks 57 of the lobes 55. The lobes 56 have portions 64 corresponding to the portions 59 of the lobes 55 and which are positioned so that they occur at the same time. In addition, the lobes 56 have flat portions 65 corresponding at least to the portions 60 but in the case of the lobes 56 the portions 65 are followed by a trailing flank portion 66 which leads down to the base circle of the cam ring, the base circle being indicated at 67.

Immediately preceding the leading flank portion 63 of the lobes 56 is a filling flank 68 having an opposite inclination to the flank portion 63. The filling flank 68 extends from a minor crest 69 which is connected to the portion 60 of the preceding lobe 55 by an inclined portion 70. It will be noted that the crest portions 61 of the cam lobes 56 are positioned nearer to the axis of rotation of the distributor member than the crests 58 of the lobes 55.

Also indicated on FIG. 6 are positions C and D, position C corresponding to closure of the slot 33 to an outlet 34 and opening of the slot or slots 32 to the inlet port or ports 37. Position D corresponds to the closure of the slot or slots 32 with the port or ports 37 and opening of the slot 33 to an outlet 34. It will be noted that positions C and D are spaced by an angle of 45°, this being appropriate for a pump for supplying fuel to a four cylinder engine.

Considering now the mode of operation of the apparatus and considering firstly the function of the lobes 55. When fuel is supplied to the bore 29 upon registration of a groove 32 with an inlet passage 37, the plungers will moved outwardly by the fuel pressure as permitted by the portions 66 of the lobes 56. In moving outwardly, outward movement is imparted to the respective shoes 45 and the rollers 44. The extent of outward movement is limited by the abutment of the tapered surfaces on the shoes and the internal surface of the enlarged portion of the shaft. By moving the distributor member axially the extent of outward movement can be varied. Thus the amount of fuel which is supplied to the bore can be controlled and this determines the amount of fuel delivered through an outlet when the plungers are moved inwardly by the action of the leading flanks 57 of the lobes 55. When the rollers 57 reach the crest of the lobes 55 delivery of fuel ceases and the portions 59 of the lobes permit limited outward movement of the plungers to take place during which time fuel is retracted from the pipe line connecting the outlet 34 which has just received fuel, with the respective injection nozzle. This permits the valve in the injection nozzle to close quickly and during this time the delivery valves 36 close. The plungers which have just delivered the main volume of fuel next perform the function of providing the initial volume of fuel as mentioned above and those plungers which have just provided the initial volume of fuel then supply the main volume of fuel. Considering now the action of the cam lobe 56. Following retraction of fuel the plungers which have just delivered fuel are held against movement but are then moved inwardly by the action of the flanks 70 of the lobes 56. The fuel displaced by these plungers is in fact supplied to the bores containing the other plungers, those bores also receiving fuel from the low pressure supply pump. When the minor crest 69 is reached, then depending upon the position of the cam ring, the plungers may or may not partake of an outward movement. If the cam ring is positioned so that the crest 69 coinsides with the point D, no outward movement of the plungers will take place and they will threfore be held against movement. As the distributor member continues to rotate the rollers associated with these plungers will engage the leading flanks 63 of the lobes 56 and inward movement will be imparted to the plungers. The plungers which are about to be moved inwardly by the leading flanks 57 of the lobes 55, are held against outward movement by the action of the stops. An initial volume of fuel will therefore be delivered to the associated engine and this will cease when the rollers reach the crests 61. The main flow of fuel will take place when the rollers of the other pair of plungers engage the flanks 57 and the interval considered in terms of rotation, will depend upon the amount of fuel being supplied. If the fuel amount is small, then there will be an appreciable delay, this delay becoming less as the quantity of fuel is increased.

If now the cam ring is moved so that the point D lies at the position indicated at D1, the plungers associated with the lobes 56 will be able to move outwardly a small amount as determined by the filling flanks 68, before the grooves 32 move out of register with the inlet ports 37. The practical effect of this is that the volume of fuel initially delivered to the engine will be increased since the rollers will engage with the leading flanks 63 of the lobes 56 earlier. The position of the cam ring is varied in accordance with the output pressure of the low pressure pump and this is arranged to increase with speed. The practical effect therefore is that with increasing speed the volume of fuel which is delivered initially to the engine increases even if the volume of fuel delivered by the plungers operated by the lobes 55 remains the same throughout the speed range.

FIG. 6 also shows the positions reached by the rollers for various axial settings of the distributor member. The line referenced E indicates a maximum fuel position, the line F the minimum fuel or idling position and the line G the position to prevent the supply of fuel to the engine. It will be noted that when the distributor member is set for minimum fuel for idling purposes, the cam lobes 55 are not effective to cause fuel supply to the engine this being achieved using the lobes 56 only. It will also be noted that all the plungers are controlled by the stops for the purpose of preventing fuel supply to the engine.

An additional line H is indicated which corresponds to an excess of fuel for starting purposes.

The axial position of the distributor member in the particular example, is varied hydraulically and this is achieved by varying the pressure within a chamber 50 defined by the end of the bore 26 and the body portion 12. The bore is closed by a closure member and fuel under pressure is supplied to the chamber 50 by way of a restricted orifice 51 carried by the sleeve 27. The orifice 51 communicates with the outlet of the pump 22 and fuel is allowed to escape from the chamber so that the pressure in the chamber can be controlled, by means of an electromagnetically controlled valve 52. The distributor member is biased by means of a coiled compression spring 53 which is housed within the blind bore 18 formed in the drive shaft. The spring acts between the drive shaft and the distributor member to urge the latter against the action of the fuel under pressure in the chamber 50. By varying the pressure in the chamber using the valve 52 the axial position of the distributor member can be controlled.

We claim:

1. A fuel pumping apparatus for supplying fuel to an internal combustion engine comprising a rotary distributor member mounted within a body part, the distributor member being arranged in use to be driven in timed relationship with an associated engine, a pumping plunger housed within a bore formed in the distributor member, a cam ring having internal pumping lobes for imparting inward movement to the plunger as the distributor member rotates, cooperating means in the distributor member and body part for conveying fuel displaced during successive inward movements of the plunger to outlet ports in turn, passage means in the distributor member for communication with an inlet port in the body part, a low pressure fuel supply pump having an outlet communicating with said port, fuel being supplied to said bore to effect outward movement of the plunger, adjustable stop means for limiting the outward movement of the plunger whereby the amount of fuel delivered at each inward stroke of the plunger can be varied, a further plunger mounted in a further bore in communication with said first mentioned bore, a further cam lobe or cam lobes on said cam ring positioned to actuate the further plunger in advance of the first mentioned plunger, said cam lobe or cam lobes having a leading flank which effects inward movement of the further plunger and a filling flank which precedes said leading flank when considered in terms of the direction of rotation of the distributor member, said filling flank allowing outward movement of the further plunger and controlling the outward movement of the further plunger while the passage means moves out of register with the inlet port, and means for adjusting the angular setting of said cam ring within the body part, said first mentioned plunger and said further plunger being located in the same radial plane, and said pumping lobes being arranged alternately with said further lobes about the internal peripheral surface of said cam ring, said plungers being each operated in turn by said pumping lobes and said further lobes.

2. An apparatus according to claim 1, in which the crest of the leading flanks of said further cam lobes is shaped to prevent outward movement of said further plunger whilst said first mentioned plunger is under the control of the leading flank of a pumping lobe.

3. An apparatus according to claim 2, in which the distance of the crests of the further cam lobes from the base circle of the cam is greater than the distance of the crests of the pumping lobes from the base circle of the cam.

4. A fuel pumping apparatus for supplying fuel to an internal combustion engine comprising a rotary distributor member mounted within a body part, the distributor member being arranged in use to be driven in timed relationship with an associated engine, a pumping plunger housed within a bore formed in the distributor member, a cam ring having internal pumping lobes for imparting inward movement to the plunger as the distributor member rotates, cooperating means in the distributor member and body part for conveying fuel displaced during successive inward movements of the plunger to outlet ports in turn, passage means in the distributor member for communication with an inlet port in the body part, a low pressure fuel supply pump having an outlet communicating with said port, fuel being supplied to said bore to effect outward movement of the plunger, adjustable stop means for limiting the outward movement of the plunger whereby the amount of fuel delivered at each inward stroke of the plunger can be varied, a further plunger mounted in a further bore in communication with said first mentioned bore, a further cam lobe or cam lobes on said cam ring positioned to actuate the further plunger in advance of the first mentioned plunger, said cam lobe or cam lobes having a leading flank which effects inward movement of the further plunger and a filling flank which precedes said leading flank when considered in terms of the direction of rotation of the distributor member, said filling flank allowing outward movement of the further plunger and controlling the outward movement of the further plunger while the passage means moves out of register with the inlet port, and means for adjusting the angular setting of said cam ring within the body part, said first mentioned plunger and said further plunger being located in the same radial plane, and said pumping lobes being arranged alternately with said further lobes about the internal peripheral surface of said cam ring, said plungers being each operated in turn by said pumping lobes and said further lobes, the crest of the leading flanks of said further cam lobes being shaped to prevent outward movement of said further plunger while said first mentioned plunger is under the control of the leading flank of a pumping lobe, the distance of the crests of the further cam lobes from the base circle of the cam being greater than the distance of the crests of the pumping lobes from the base circle of the cam, each cam lobe being shaped to define a retraction portion following the crests, during which each plunger is allowed a limited outward movement, said retraction portions being followed by dwell portions, the dwell portion following the retraction portion on the pumping lobes leading into an inclined portion preceding the filling flank of said further lobe, and the dwell portion of said further lobe being followed by a trailing flank portion extending to the base circle.

* * * * *